US006041864A

United States Patent [19]

Patel et al.

[11] Patent Number: 6,041,864

[45] Date of Patent: Mar. 28, 2000

[54] WELL ISOLATION SYSTEM

[75] Inventors: Dinesh R. Patel, Sugarland; Christian C. Spring, Houston, both of Tex.

[73] Assignee: Schlumberger Technology Corporation, Sugar Land, Tex.

[21] Appl. No.: 09/197,973

[22] Filed: Nov. 23, 1998

Related U.S. Application Data

[60] Provisional application No. 60/069,805, Dec. 12, 1997.

[51] Int. Cl.[7] ..... E21B 34/14

[52] U.S. Cl. ..... 166/332.4; 166/66.7; 166/373; 137/487.5

[58] Field of Search ..... 166/332.4, 332.3, 166/319, 321, 373, 375, 386, 66.6, 66.7; 137/487.5; 251/129.04, 63.5

[56] References Cited

U.S. PATENT DOCUMENTS

| | | | |
|---|---|---|---|
| 4,215,746 | 8/1980 | Hallden et al. . | |
| 4,274,486 | 6/1981 | Fredd | 166/250 |
| 4,280,561 | 7/1981 | Fredd . | |
| 4,356,867 | 11/1982 | Carmody . | |
| 4,417,600 | 11/1983 | Kohn . | |
| 4,420,045 | 12/1983 | McMahan . | |
| 4,579,177 | 4/1986 | Going, III | 166/332 |
| 4,627,492 | 12/1986 | MacLaughlin . | |
| 4,796,699 | 1/1989 | Upchurch . | |
| 4,806,928 | 2/1989 | Veneruso . | |
| 4,856,595 | 8/1989 | Upchurch . | |
| 4,896,722 | 1/1990 | Church . | |
| 4,901,069 | 2/1990 | Veneruso . | |
| 4,915,168 | 4/1990 | Upchurch . | |
| 4,971,160 | 11/1990 | Upchurch . | |
| 4,979,569 | 12/1990 | Anyan et al. . | |
| 5,008,664 | 4/1991 | More et al. . | |
| 5,050,675 | 9/1991 | Upchurch . | |
| 5,058,673 | 10/1991 | Muller et al. . | |
| 5,090,481 | 2/1992 | Pleasants et al. . | |
| 5,172,717 | 12/1992 | Boyle et al. | 137/155 |
| 5,263,683 | 11/1993 | Wong . | |
| 5,337,827 | 8/1994 | Hromas . | |
| 5,518,073 | 5/1996 | Manke et al. . | |
| 5,535,828 | 7/1996 | Der Kinderen . | |
| 5,664,629 | 9/1997 | Maitland . | |
| 5,782,304 | 7/1998 | Garcia-Soule et al. | 166/356 |
| 5,810,087 | 9/1998 | Patel . | |

FOREIGN PATENT DOCUMENTS

| | | |
|---|---|---|
| 2 213 181 | 8/1989 | United Kingdom . |
| 23122909 | 11/1997 | United Kingdom . |
| WO 97/27382 | 7/1997 | WIPO . |

OTHER PUBLICATIONS

Schlumberger, "Formation Isolation Valve (FIV)," p.1 (Jan. 1997).

Schlumberger, "Liner Top Isolation Valve —LTIV," p. 1 (publication date unknown).

Schlumberger, "Formation Isolation Valve (FIV)," p. 1 (Aug. 1997).

Schlumberger, "Linear Top Isolation Valve (LTIV)," p. 1 (Sep. 1997).

Schlumberger, "IRIS Operated Dual Valve (IRDV–AB)," p. 1 (Oct. 1997).

*Primary Examiner*—David Bagnell
*Assistant Examiner*—Zakiya Walker
*Attorney, Agent, or Firm*—Jeffrey E. Griffin; Jaime A. Castano; John R. Ryberg

[57] ABSTRACT

A fluid control system actuatable by a tool includes a valve and a valve operator coupled to operate the valve between an open and closed position. The valve operator is adapted to be responsive to signals generated by the tool such that a first combination is received when the tool is run in a first direction and a second combination is received when the tool is run in a second direction. The valve operator includes electronic circuitry adapted to actuate the valve open in response to the first combination and to actuate the valve closed in response to the second combination.

33 Claims, 5 Drawing Sheets

WELL ISOLATION SYSTEM

This application claims priority under 35 U.S.C. § 119 to U.S. Provisional Patent Application Ser. No. 60/069,805, filed on Dec. 12, 1997.

BACKGROUND

The invention relates to well isolation systems including one or more valves actuatable by command signals.

In a wellbore, one or more valves may be used to control flow of fluid between different sections of the wellbore. The different sections may include multiple completion zones in vertical or deviated wells or in multilateral wells. Various types of valves have been used to control fluid flow, including formation isolation valves that are actuatable open or shut to allow access to sections of the wellbore. In one configuration, a formation isolation valve may include a ball valve rotatable to open and closed positions. The ball valve includes a bore that when in the open position is aligned to the bore of tubing in the well so that fluid communication can be established in well sections above and below the ball valve.

During completion operations, the formation isolation valve may initially be kept shut to isolate the wellbore section downstream from the valve. When a completion task (such as perforating operations) needs to be performed in the downstream section, the formation isolation valve may be opened and a completion tool (e.g., a perforating gun) can be lowered through the bore of the ball valve in the formation isolation valve to the downstream section for operation. Examples of other completion tools include tools for setting packers and bridge plug tools for sealing plugs at predetermined depths. Once the completion task is performed, the completion tool may be removed from the downstream section, with the formation isolation valve closed after removal of the tool to again isolate the downstream wellbore section.

With some formation isolation valves, a mechanical operator mechanism may be used to open or shut the formation isolation valve. Such mechanical operator mechanisms may include a shifting tool that engages a valve operator in the formation isolation valve to rotate the ball valve between the open and closed positions. A shifting tool typically may include a latching profile to engage a corresponding profile of the valve operator in the formation isolation valve. However, such an engagement profile may cause the shifting tool to catch onto debris or other downhole surfaces as the shifting tool is moved in the well. This may cause the shifting tool to be stuck downhole which may render retrieval of the completion tool difficult or impossible. Another potential issue is that, as the shifting tool is raised and lowered in the wellbore, the engagement profile of the shifting tool may be damaged due to rubbing contact to surfaces downhole, which may decrease the reliability of shifting tool operation of the formation isolation valve.

Thus, a need arises for an improved operator mechanism to actuate equipment, such as formation isolation valves, in a wellbore.

SUMMARY

In general, according to one embodiment, a fluid control system actuatable by a tool includes a valve and a valve operator coupled to operate the valve between an open and closed position. The valve operator is adapted to be responsive to signals generated by the tool such that a first combination is received when the tool is run in a first direction and a second combination is received when the tool is run in a second direction.

Other features will become apparent from the following description and from the claims.

DETAILED DESCRIPTION

Figure 1:
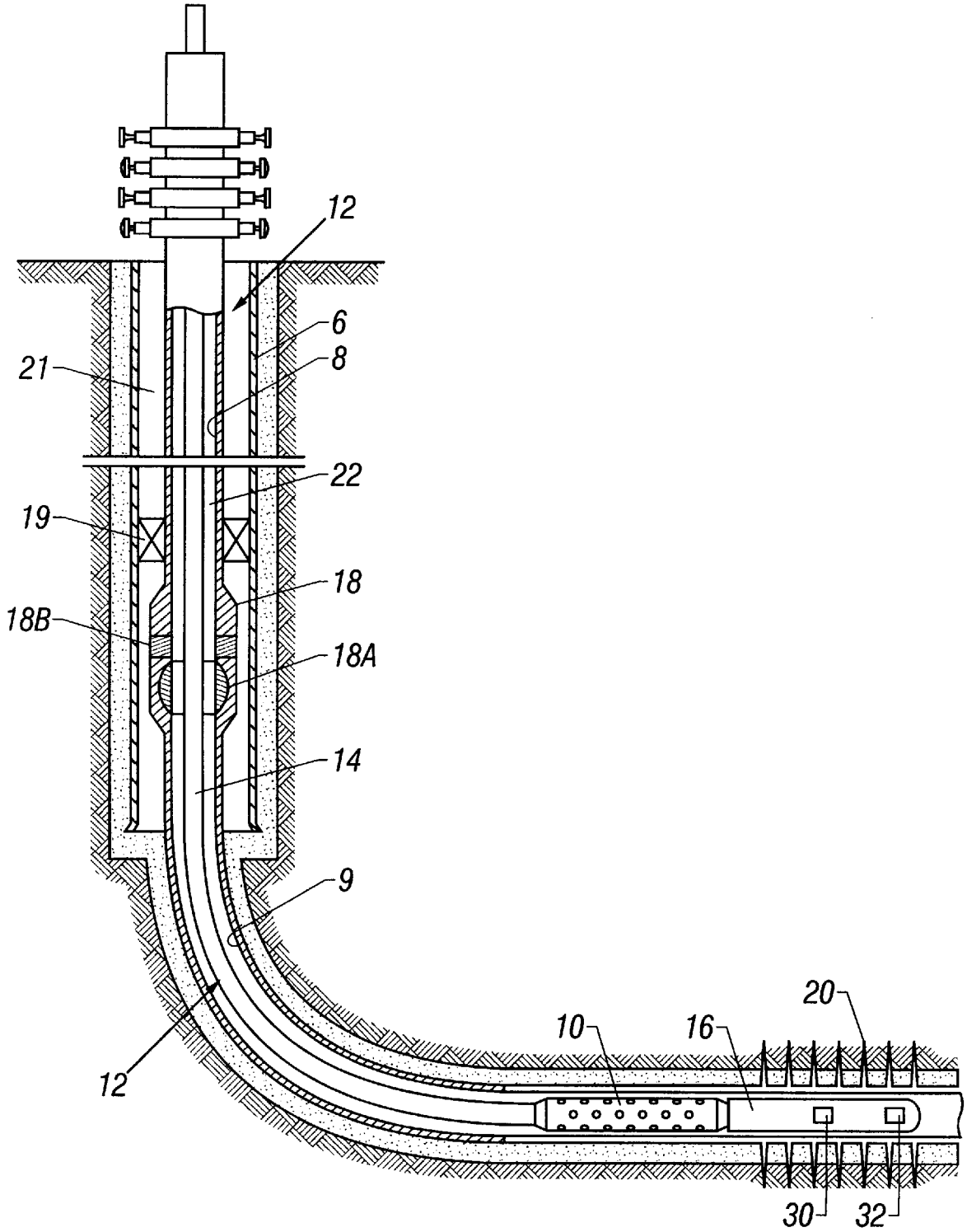
FIG. 1 is a diagram of a formation isolation system according to an embodiment positioned in a wellbore.

In the following description, numerous details are set forth to provide an understanding of the present invention. However, it is to be understood by those skilled in the art that the present invention may be practiced without these details and that numerous variations or modifications from the described embodiments may be possible.

According to some embodiments of the invention, a formation isolation system includes a valve operating mechanism that is responsive to command signals transmitted in the wellbore from other devices, including devices located at the well surface. In some embodiments, a first type of command signals may be in the form of pressure pulses that are transmitted down the wellbore and decoded by pressure sensing devices in the valve operating mechanism. The pressure signals may be converted to electrical signals to control actuation of the valve operating mechanism. This first type of command signals may include a relatively low-level pressure pulse or a series of such pulses. In one example, the duration of each pressure pulse may be several seconds, with a duration also in the range of a few seconds between successive applied pulses. Each pressure pulse may be relatively low in magnitude, e.g., less than about 500 psi.

According to one embodiment, the pressure pulse may be transmitted through the bore of a tubing that extends from the well surface to the downhole formation isolation system. In certain other embodiments, the fluid pressure may be applied through a tubing-casing annulus or other suitable passage way (e.g., narrow tubing passed through packers positioned upstream to the formation isolation system). Two distinct sets of pressure pulse commands may be used for operating a valve in the formation isolation system. To open the valve in the system, a first set of low-level pressure pulse commands may be transmitted down the wellbore, which may be sensed by a pressure transducer and processed by downhole electronic circuitry. To close the valve, a second set of pressure pulse commands may be transmitted to the formation isolation system. Such pressure pulse commands are described in U.S. Pat. Nos. 4,896,722; 4,915,168 and Reexamination Certificate B1 U.S. Pat. Nos. 4,915,168; 4,856,595; 4,796,699; 4,971,160; and 5,050,675, having common assignee as the present application and hereby incorporated by reference. The techniques and apparatus described in those patents may be applied to actuate the formation isolation system according to some embodiments. However, further embodiments are described below.

In some embodiments, a second type of command signals different from pressure pulse commands may be used to actuate the valve in the formation isolation system. This second type of command signals may be transmitted through an inductive coupler switch. In one embodiment, a female coil may be part of the formation isolation system and male coils may be lowered on an inductive coupler shifting tool down the wellbore. The male and female coils form part of the inductive coupler switch. When the male coils pass through the female coil in the formation isolation system, a valve in the formation isolation system may be actuated to open or closed positions based on the longitudinal direction of movement of the tool. Alternatively, the inductive coupler switch may include a male coil in the shifting tool and multiple female coils in the valve operator mechanism of the formation isolation system. In further embodiments, a passive male element (formed of a magnetic material, for example) may be included in the shifting tool while multiple female coils may be included in the valve operator. When the passive male element is positioned near a female coil, the inductance of the female coil may be increased to indicate presence of the passive male element.

Power to the male coils in the tool may be provided by a battery, or alternately, it may be provided by an electrical cable (through a wireline, coiled tubing, or other suitable transport mechanism) coupled to a power source at the well surface. However, if a passive male coil is used, power to the male element is not needed.

Inductive coupler techniques and apparatus are described in U.S. Pat. Nos. 4,806,928 and 4,901,069, having common assignee as the present application and hereby incorporated by reference. Such inductive coupler techniques and apparatus may be applied to operate the formation isolation system according to some embodiments, although further embodiments are described below.

Alternatively, other types of command signals may be used to control the formation isolation system either in place of the pressure pulse or inductive coupler signals or in addition to those signals. For example, such other types of signals may include acoustic signals, wireless signals, and other signals. Further, mechanical shifting tools may also optionally be used to operate the formation isolation system, which may be advantageous in case of failure of electronic circuitry to decode command signals. A tripless activating mechanism may also be included in the formation isolation system, which may be activated by one or more relatively high pressure cycles (multiple pressure cycles if a counter mechanism is included), with applied pressures typically in the range of thousands of pounds per square inch (psi).

Referring to FIG. 1, an example wellbore 12 having a vertical section and a deviated section is illustrated. Casing 6 is cemented to the inner wall of a first portion of the wellbore 12. A tubing string 8 coupled to surface equipment extends through the vertical section of the wellbore 12, and a pipe 9 coupled below the tubing string 8 extends through the remaining portion of the vertical wellbore section and deviated wellbore section. A formation isolation system 18 may be coupled near the bottom end of the tubing string 8 to control fluid communication between the tubing string 8 and the pipe 9. In further embodiments, multiple formation isolation systems may be positioned downhole at different depths for isolating more sections of the wellbore.

In one embodiment, the formation isolation system includes a ball valve 18A and a valve operator mechanism 18B, which may be actuated to open and close the valve 18A according to some embodiments of the invention. When closed, the ball valve 18A prevents fluid communication between the tubing string 8 and pipe 9. When opened, the bore of the ball valve 18A is longitudinally aligned with the bores of the tubing string 8 and pipe 9 to allow fluid communication.

As illustrated, a tool string 10, such as a perforating string, may be lowered on a coiled tubing 14, for example, or by another suitable mechanism, into the bore of the tubing string 8 and through the bore of the formation isolation system 18. The perforating string 10 may be inserted to a predetermined position and fired to create perforations in the pipe 9 and in the adjoining formation layer to create formation fluid flow into the pipe 9.

Coupled at the bottom end of the tool string 10 may be an inductive coupler shifting tool 16 according to an embodiment of the invention that is capable of producing a command signal in the operating mechanism 18B to actuate the ball valve 18A. In one embodiment, the shifting tool 16 may include two male coils 30 and 32 that in cooperation with a female coil in the valve operator mechanism 18B forms part of the inductive coupler switch. In another embodiment, two female coils may be located in the valve operator mechanism 18B and a male coil may be located in the shifting tool 16, although different numbers of female and male coils may be used in further embodiments. In the described embodiments, one portion of the inductive coupler switch is located in the valve operating mechanism 18B downhole, and the other portion of the inductive coupler switch is located in the shifting tool 16 lowered into the wellbore 12.

In the shifting tool 16, the male coil 30 is positioned some distance apart longitudinally from the male coil 32 in the shifting tool 16. When a male coil 30 or 32 is positioned next to the female coil in the operator mechanism 18B, a signal is generated in the female coil. The male coils 30 and 32 output signals having different signatures so that the valve operating mechanism 18B can determine which of the male coils is next to it. If the lower male coil 32 is passed through the female coil before the upper male coil 30 (indicating that the shifting tool 16 is being inserted into the wellbore), the ball valve 18A is actuated open. Conversely, if the upper male coil 30 passes through the female coil before the lower male coil 32 (indicating removal of the well tool), the ball valve 18A is actuated closed.

In a further embodiment, two female coils are included in the valve operator mechanism 18B and one active male coil is included in the shifting tool 16. In such an embodiment, the valve operator mechanism 18B is able to determine which of the female coils is first activated in response to a signal generated by the male coil. In another embodiment, two female coils are included in the valve operator mechanism 18B and one passive male element is included in the shifting tool. In this embodiment, passage of the male element near the female coils cause an increase in inductance in the female coils.

As an added feature, a time lag may be built into the formation isolation system 18 to prevent actuation of the valve operator mechanism 18B until after a predetermined amount of time after the male coils 30 and 32 have passed by the female coil 34. By using an inductive coupler switch to operate the formation isolation system 18, a back-up operating mechanism in addition to the pressure pulse actuation mechanism is provided.

According to further embodiments, the valve operator mechanism 18B may be configured to detect if the shifting tool 16 has been raised out of the formation isolation system 18 within a predetermined period (e.g., about 5 minutes) of time after it has been lowered through the formation isolation system 18. If so, the valve operator mechanism 18B does not close the valve 18A.

An aspect of the inductive coupler shifting tool 16 is that it may have a smooth external profile in embodiments without a mechanical latch profile. The smooth profile reduces the likelihood of the shifting tool 16 being caught downhole. In addition, because of the contactless feature of the inductive coupler switch, there does not exist an engagement profile on the shifting tool 16 in some embodiments that may be damaged due to scraping with rough surfaces downhole. A further aspect of the inductive coupler shifting tool 16 is that the cross-section of the shifting tool 16 does not need to be matched to a corresponding profile in the valve operator mechanism 18B. A gap may exist between the shifting tool 16 and the female coil and the valve operator mechanism 18B may still be actuated. This may allow a smaller set of standard shifting tools that may be used for many different types of applications. This helps to reduce the cost associated with making the shifting tools as well as increases the likelihood that such shifting tools are readily available.

As noted above, the valve operator mechanism 18B may also include a pressure sensor that is capable of sensing low-level pressure pulse command signals transmitted from the well surface to actuate the valve 18A in the formation isolation system 18. According to some embodiments, the pressure actuated command signals can open and close the valve 18A multiple times as desired so long as the low-level pressure pulses may be communicated to the formation isolation system 18. This may not be true once the formation has been perforated and formation fluid is flowing into the tubing string bore. In that case, actuation of the formation isolation system 18 may be accomplished with the inductive coupler shifting tool 16, or alternatively, with a mechanical shifting tool or other suitable mechanisms.

An example application of the formation isolation system 18 is described below. The ball valve 18A may be run into the wellbore 12 in the open position to allow the completion tubing 8 to fill with completion fluids. A pressure pulse command may be sent to close the ball valve 18A at any time while the ball valve 18A is run into the wellbore 12. In one application, as the tubing string 8 is being assembled downhole with the ball valve 18A attached near the bottom end, the ball valve 18A may be closed by application of a low-level pressure pulse command, and the existing tubing section may be pressure tested against the closed ball valve to determine the integrity of the tubing. Thus, any leak in the tubing may be detected during assembly of the tubing, without having to wait until the entire tubing string has been assembled before the pressure test can be performed.

After a tubing section is pressure tested and no leaks are detected, another pressure pulse command can be sent down to open the ball valve 18A. Additional sections of the tubing can then be added, with pressure testing performed periodically by closing and opening the ball valve 18A with pressure pulse commands. After the tubing has been completely assembled, the ball valve 18A is kept in the closed position and tubing pressure may be raised to a predetermined level to set a packer 19 to isolate an annular region 21 between the outer wall of the tubing 8 and the inner wall of the casing 6. It is noted that the packer 19 in one embodiment is positioned above the formation isolation system 18. Thus, once the packer 19 is set, pressure pulse commands are typically transmitted down the bore of the tubing string unless a mechanism is provided to communicate applied pressure in the annulus 21 to the valve operator mechanism 18B of the formation isolation system 18.

After the packer 19 is set, the ball valve 18A may then be opened by a pressure pulse command to allow a perforating string 10 to be run down through the tubing string 8 and the pipe 9. Alternatively, the ball valve 18A may be actuated open by the inductive coupler shifting tool 16 attached to the end of the perforating string 10. When the shifting tool 16 is lowered through the female coil in the valve operator mechanism 18B, the ball valve 18A is actuated to an open position (if the ball valve is not already open) to allow the gun string 10 to pass through. After the gun string 10 is lowered to a predetermined location, it may be fired to perforate the well section, and the string 10 is pulled back out of the hole. When the shifting tool 16 is raised above the ball valve 18A and through the female coil, the ball valve 18A is closed by signals generated by the inductive coupler switch. The tubing pressure may then be bled off and the gun string 10 may be retrieved to the surface.

Next, if desired, a pressure pulse command signal may be sent down and detected by the pressure transducer 176 to re-open the ball valve 18A so that the well can begin flowing. If for any reason the pressure pulse command is unable to open the ball valve, then the inductive coupler switch or other suitable mechanism may be run back into the formation isolation assembly to open the valve.

Figure 2A:
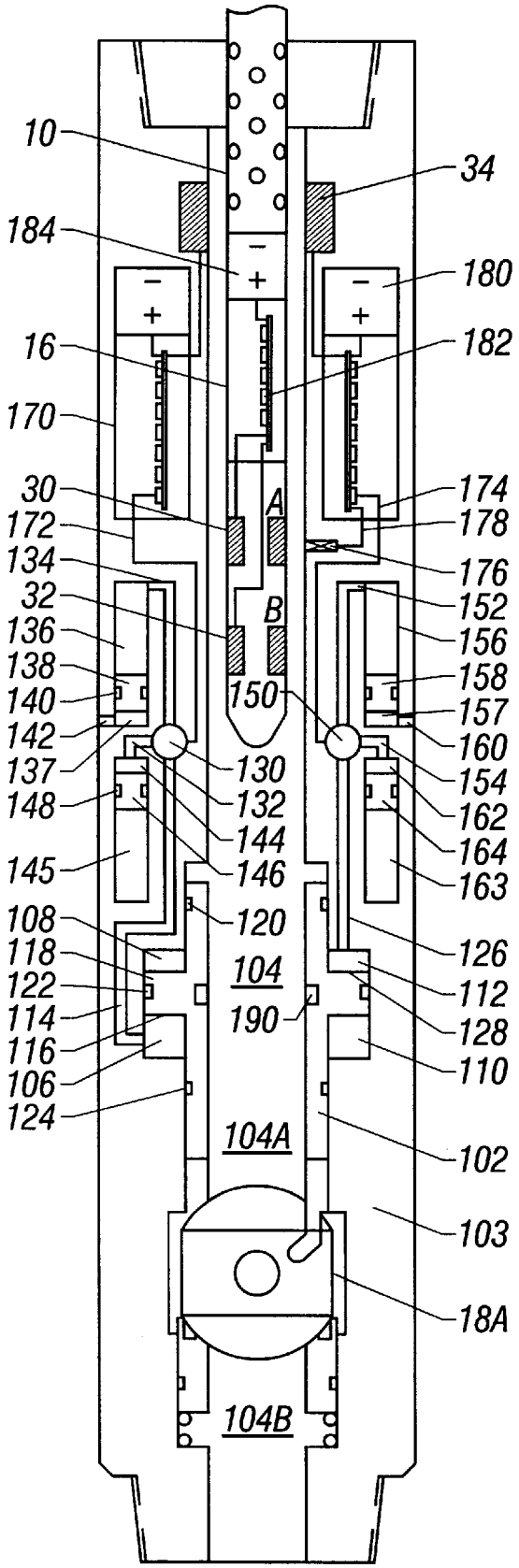
FIGS. 2A–2B illustrate formation isolation systems according to embodiments.

Referring to FIG. 2A, the formation isolation system 18 is illustrated in greater detail. The ball valve 18A, contained within housing 103, is positioned near the bottom of the formation isolation system 18. The ball valve 18A is actuated to an open or closed position by a power mandrel 102 moveable along the longitudinal axis of the formation isolation system 18 to rotate the ball valve 18A. If the power mandrel 102 is moved up, the ball valve 18A is closed; if the power mandrel 102 is moved down, the ball valve 18A is opened.

When the ball valve 18A is closed, an upstream section 104A of the bore 104 defined in the housing 103 of the formation isolation system 18 is isolated from a downstream section 104B of the bore 104. When the ball valve 18A is open, the bore of the ball valve is aligned with the bore 104 to allow fluid to communicate between the two sections 104A and 104B. In the illustrated embodiment, the tubing string 8 is coupled above the formation isolation system 18, and the pipe 9 is coupled below the formation isolation system.

In the embodiment of FIG. 2A, the power mandrel 102 is movable in the up direction by differential pressure applied between chamber sections 106 and 108 and in the down direction by differential pressure between chamber sections 110 and 112. Sections 106 and 108 form a chamber that is divided by a flange portion 118 of the power mandrel 102. Sections 110 and 112 form a chamber that is divided by the flange portion 118. In the illustrated embodiment, the chamber section 106 is coupled to a fluid channel 114 that is capable of communicating fluid to the chamber section 106, which initially may be at approximately atmospheric pressure. The chamber section 108 may be an atmospheric chamber that may be filled with air or other suitable gas. If fluid is communicated to the chamber section 106 through the channel 114, sufficient pressure may be applied on a bottom surface 116 of the flange portion 118 of the power mandrel 102 to move the power mandrel 102 in the up direction to close the valve 18A.

On the other side, a fluid channel 126 is coupled to communicate fluid to the chamber section 112, which initially also may be at approximately atmospheric pressure. The chamber section 110 is an atmospheric chamber that may be filled with air or other suitable gas. When fluid is communicated through the channel 126 to the chamber section 112, sufficient pressure may be applied on a top surface 128 of the flange portion 118 to push the power mandrel 102 in the down direction. The chamber sections 106, 108, 110 and 112 are sealed from each other by seals 120, 122, and 124.

Fluid can be provided into or drawn from the chamber sections 106 and 112 through channels 114 and 126, respectively. Thus, to move the power mandrel 102 up, the chamber section 106 is filled with fluid to apply pressure on the bottom surface 116 of the flange portion 118 while the chamber section 112 is maintained at approximately atmospheric chamber. Similarly, to move the power mandrel 102 down, the chamber section 112 is filled with fluid to apply pressure on the top surface 128 of the flange portion 118, with fluid removed from the chamber section 106 to keep the chamber section 106 at approximately atmospheric pressure.

Fluid is provided to and removed from the chamber sections 106 and 112 through solenoid valves 130 and 150, respectively. According to one embodiment, the channel 114 couples the chamber section 106 to the 3-way solenoid valve 130, which controls fluid flow among fluid channels 114, 132, and 134. The solenoid valve 130 may be a 2-position, 3-way valve that may be activated between an open and closed position. In the open position, the channel 134 and the channel 114 are in communication with each other. In the closed position, the channel 132 is in communication with the channel 114.

The channel 134 is coupled between the solenoid valve 130 and a hydrostatic chamber section 136 that is filled with a fluid, such as oil. A compensating piston 138 sits between the chamber section 136 and another chamber section 137, which is in fluid communication with a port 142 that is open to the outside of the formation isolation system 18 to receive well fluid. Sections 136 and 137 form a chamber that is divided by the piston 138. A seal, such as an 0-ring seal 140, around a portion of the piston 138 provides a fluid seal between chamber sections 136 and 137. The assembly including chamber sections 136, 137 and the piston 138 is referred to as a first activating piston assembly.

Once well fluid flows into the chamber section 137, pressure tends to push the piston 138 up, which forces fluid in the chamber section 136 into the channel 134. If the solenoid valve 130 is open, then the fluid from the chamber section 136 flows to the channel 114 and into the chamber section 106 to apply pressure to push the power mandrel 102 in the up direction.

When the solenoid valve 130 is deactivated to a closed position, communication between the channels 134 and 114 is cut off; however, the solenoid valve 130 couples the channel 132 to the channel 114 to allow fluid communication between the two channels. The channel 132 is coupled between the solenoid valve 130 and a first fluid dump assembly including an upper chamber section 144, a piston 146, and a lower chamber section 145. The sections 144 and 145 form a chamber that is divided by the piston 146. When the solenoid valve 130 is in the closed position, fluid that may exist in the chamber section 106 is allowed to flow through the channel 132 and solenoid valve 130 into the chamber section 144. Fluid flow into the chamber section 144 pushes the piston 146 downwards into the chamber section 145. The chamber section 144 effectively acts as a dump chamber into which fluid from the chamber section 106 can be dumped.

In another part of the formation isolation system 18, the solenoid valve 150 selectively couples fluid channels 126, 152, and 154 in similar fashion. Again according to one embodiment, the solenoid valve 150 may be a 2-position, 3-way valve. When in the open position, the valve 150 allows fluid communication between the channels 126 and 152. When the valve 150 is closed, communication between the channels 126 and 152 is disabled but communication is allowed between the channels 126 and 154.

The channel 152 is coupled between the solenoid valve 150 and a second activating piston assembly including an upper chamber section 156, a piston 158, and a lower chamber section 157. The sections 156 and 157 form a chamber that is divided by the piston 158. The lower chamber section 157 is coupled to a port 160 capable of channeling well fluid from the outside into the chamber section 157. The upper chamber section 156 is filled with a fluid, such as oil. When well fluid pressure pushes the piston 158 up, and the solenoid valve 150 is in the open position, fluid in the upper chamber section 156 is pushed through the channel 152, the solenoid valve 150, and the channel 126 into the chamber section 112. This applies pressure to push the power mandrel 102 in a downward direction to open the valve 18A.

When the solenoid valve 150 is in the closed position, fluid in the chamber section 112 is allowed to flow through the channel 126, the solenoid valve 150, and the channel 154 into a second fluid dump assembly including a dump chamber section 162, a piston 164, and an atmospheric chamber section 163. The sections 162 and 163 form a chamber that is divided by the piston 164. When the solenoid valve 150 is open, fluid flow from chamber section 112 into the dump chamber section 162 to push the piston 164 downwards.

Each of the solenoid valves 130 and 150 are controlled by electronics circuitry 170 over electrical lines 172 and 174 respectively. Power to the electronics circuitry 170 may be provided by a battery 180 in the formation isolation system 18. In response to command signals, the electronics circuitry 170 may generate appropriate signals on lines 172 and 174 to activate or deactivate solenoid valves 130 and 150. To open the ball valve 18A, the solenoid valve 130 is deactivated closed and the solenoid valve 150 is activated open to push the power mandrel 102 downwards. To close the ball valve 18A, the solenoid valve 130 is activated open and the solenoid valve 150 is deactivated closed to move the power mandrel 102 upwards.

Two types of command signals may be received by the valve operator mechanism 18B according to one embodiment: low-level pressure pulse commands and inductive coupler switch commands. Command signals including pressure pulses may be received by a pressure transducer 176, which converts the pressure pulses into electrical signals that are transmitted over an electrical line 178 to the electronics circuitry 170. To alternately open and close the ball valve 18A, a first set of commands may cause the solenoid valve 130 to open and the solenoid valve 150 to close, and a second set of commands may cause the solenoid valve 130 to close and the solenoid valve 150 to open.

The other valve operating mechanism includes an inductive coupler switch formed of the female coil 34 and male coils 30 and 32 in one embodiment. Male coils 30 and 32 are attached in an inductive coupler shifting tool 16, which is mounted to the bottom of tool string 10. In the shifting tool 16, the male coil 30 is positioned a distance above the male coil 32. Each of the male coils 30 and 32 are coupled to electronic circuitry 182 powered by a battery 184. In an alternative embodiment, power to the electronic circuitry 184 may be provided through an electrical cable, such as through a wireline, coiled tubing, or other suitable transport mechanism.

Figure 2B:
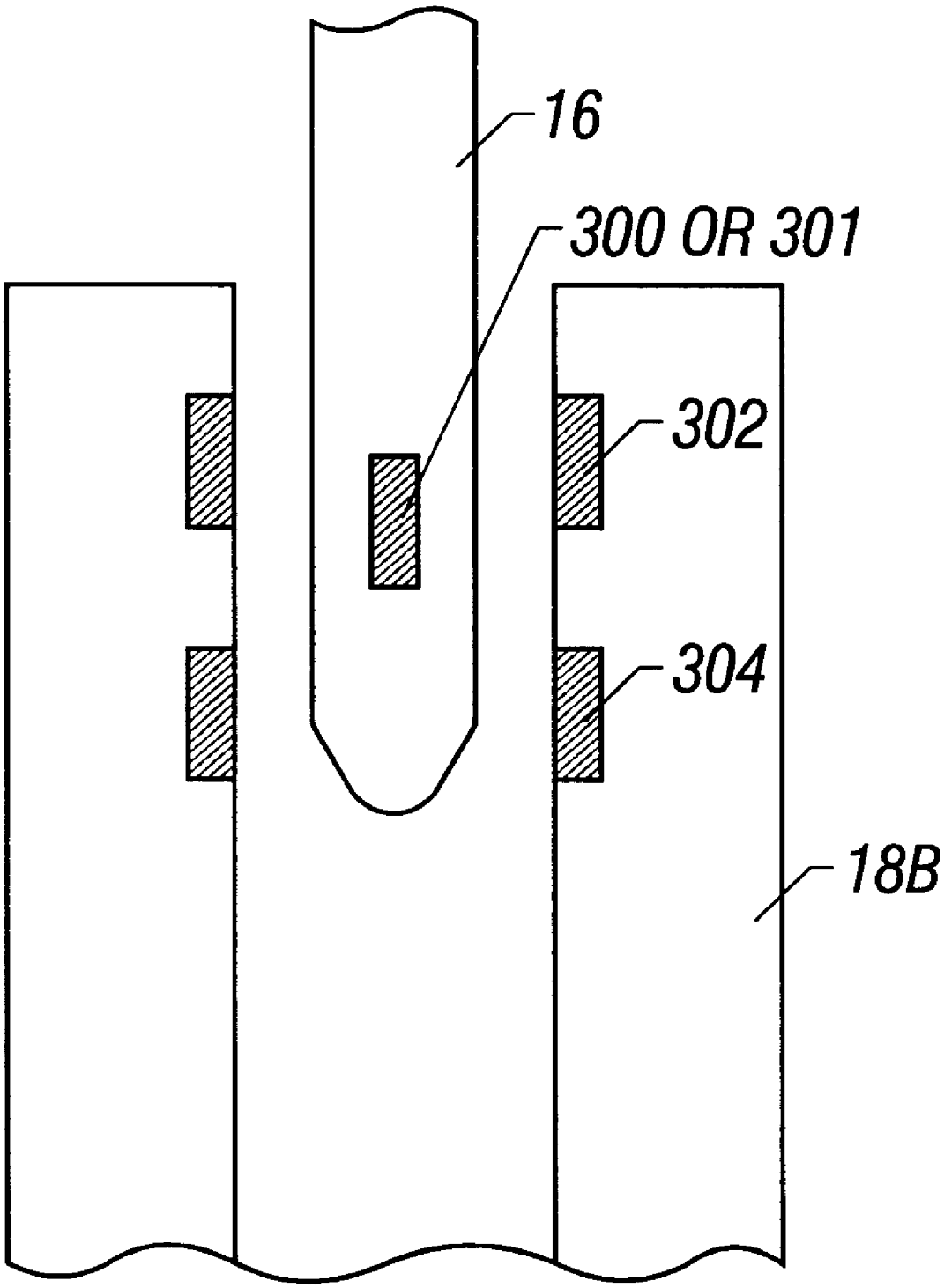

An alternative embodiment of the inductive coupler switch is illustrated in FIG. 2B, in which two female coils 302 and 304 are included in the valve operator mechanism 18B and an active male coil 300 or passive male element 301 is included in the shifting tool 16. An active male coil 300 is powered a battery in the shifting tool 16 or through an electrical cable from another power source.

A passive male element 301 is not powered by an electrical source. Instead, the passive male element 301 may be formed of a magnetic material, which may include a magnetic steel material (e.g., a material including stainless steel or silicon steel) or a magnetic ceramic material. One characteristic of the magnetic ceramic material according to one embodiment may be that it is an electrically insulator but a magnetic conductor. When the passive male element 301 is placed next to one of the female coils 302 and 304, the inductance of the female coil 302 or 304 is increased. Such an increase in inductance may be detected by circuitry coupled to the female coil 302 or 304. Direction of movement of the shifting tool 16 may be determined based on which of the female coils 302 and 304 detects the passive male element 301 first.

Referring again to the embodiment of FIG. 2A, as the shifting tool 16 is lowered or raised in the bore 104 of the formation isolation system 18, the male coils 30 and 32 in the shifting tool 16 pass through the female coil 34 that surrounds a section of the bore 104. In one embodiment, the male coils 30 and 32 are adapted by the electronic circuitry 182 to transmit signals having different signatures. Thus, if the shifting tool is lowered into the formation isolation system 18, the female coil 34 would detect that the male coil 32 has passed before the male coil 30. If the shifting is removed from the formation isolation system 18, then the female coil 34 would detect that the male coil 30 has passed before the male coil 32. In this manner, the electronic circuitry 170 can detect the direction of movement of the shifting tool 16. According to an embodiment, downward movement of the shifting tool 16 causes the electronic circuitry 170 to operate the solenoid valves 130 and 150 to open the ball valve 18A. Upward movement of the shifting tool 16 causes the electronic circuitry 170 to operate the solenoid valves 130 and 150 to close the ball valve 18A.

As illustrated, the shifting tool 16 is attached to the bottom of the tool string 10. This is to ensure that the ball valve 18A does not shut on the tool string 10 as it is raised from the ball valve. In addition, the electronic circuitry 170 is configured to provide a time delay after sensing presence of the male coils 30 and 32 before closing the ball valve 18A. This is to reduce the likelihood of the ball valve 18A closing on the tool 10.

As an added redundancy in case of failure of electronics in the valve operator mechanism, a latch profile 190 may be provided in the power mandrel 102 such that a mechanical shifting tool may be used to actuate the ball valve 18A to the open or closed position. In addition, a tripless pressure cycle actuation mechanism may also be employed, such as those described in U.S. patent applications Ser. No. 09/042,949, filed Mar. 17, 1998 entitled "Formation Isolation Valve"; and U.S. Pat. No. 5,810,087 issued Sep. 22, 1998 entitled "Formation Isolation Valve Adapted For Building A Tool String Of Any Desired Length Prior To Lowering The Tool String Downhole For Performing A Wellbore Operation, "both having common assignee as the present application and hereby incorporated by reference.

Figure 3:
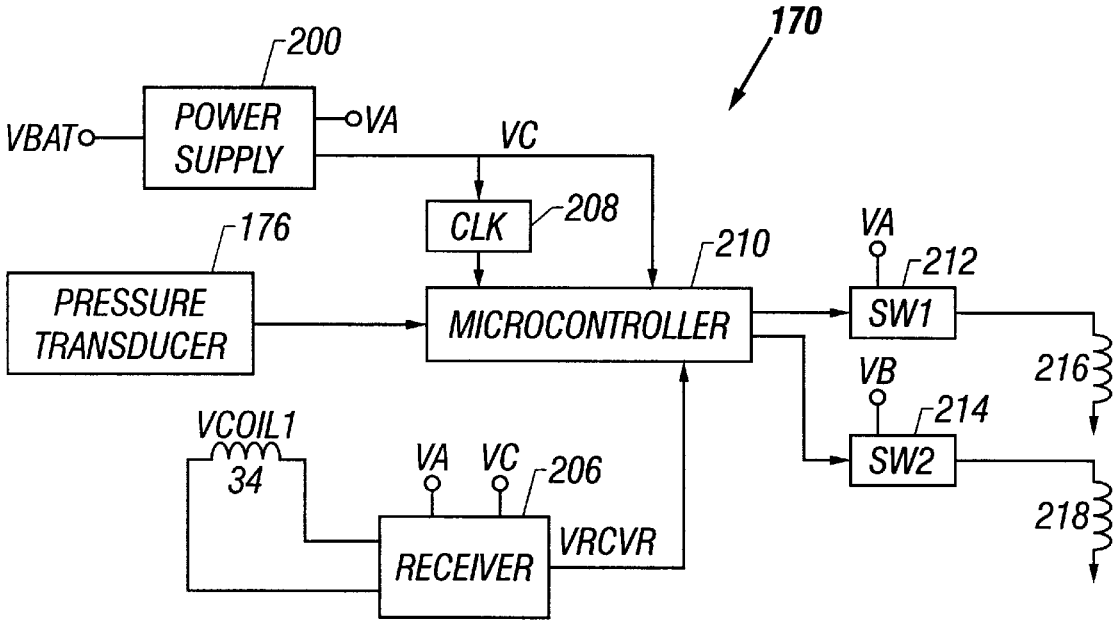
FIGS. 3 and 4 are diagrams of electronic circuits that form part of a valve operating mechanism for the formation isolation system of FIG. 2A.

Referring to FIG. 3, a portion of the electronic circuitry 170 coupled to the female coil 34 is illustrated. Power supply voltages VA and VC are provided by a power supply 200 that is coupled to receive the output VBAT of the battery 180. The voltage VA may be about 24 V, for example, and the voltage VC may be about 5 V, for example.

Figure 5:
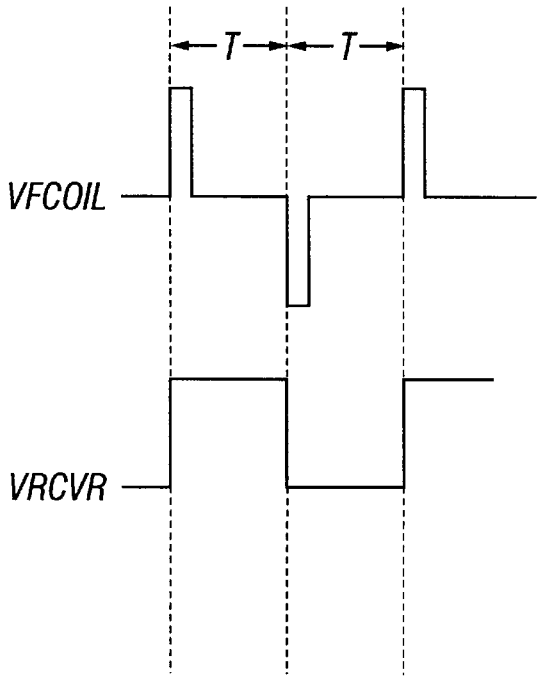
FIGS. 5 and 6 are timing diagrams of signals generated in the electronic circuits of FIGS. 3 and 4.

The two ends of the female coil 34 are coupled to the inputs of a receiver 206 that is capable of detecting signals induced in the female coil 34. As described, the male coils 30 and 32 are adapted to transmit signals having different signatures. In one embodiment, the signals may be a train of pulses alternating between positive and negative polarities, as illustrated in FIG. 5, although different signals may be transmitted in further embodiments. When either of the male coils 30 and 32 are passed next to the female coil 34, a corresponding signal VFCOIL is induced in the female coil 34. The duration between pulses on VFCOIL is expressed as a value T. The duration T is different depending on which of the two male coils 30 and 32 induced the signal in the female coil. The signal VFCOIL is received by the receiver 206, which converts the train of positive and negative polarity pulses into a square wave signal at its output, VRCVR (as illustrated in FIG. 5). The signal VRCVR has a frequency that is based on the duration T of the wave form VFCOIL. In other embodiments, the input signal VFCOIL may be converted to a different type of signal by the receiver 206.

The output VRCVR of the receiver 206 is provided to the microcontroller 210 for processing. The microcontroller 210 receives the power supply voltage VC as well as a clock from a clock generator 208. In one embodiment, the microcontroller 210 may include a counter receiving the square wave signal at VRCVR and the clock from the clock generator 208 to determine the frequency of VRCVR. From the determined frequency, the microcontroller 210 can determine which male coil 30 or 32 induced the signal in the female coil 34.

The microcontroller 210 may also provide activation signals to switch circuits 212 and 214 that are coupled to coils 216 and 218, respectively. The switch circuits 212 and 214 are also coupled to the supply voltage VA. Depending on the activation signals provided by the microcontroller 210, one of the switch circuits 212 and 214 may be activated to generate a signal in the corresponding coil 216 or 218. The coil 216 is adapted to activate or deactivate the solenoid valve 130 over signal line 172 (which in this case may be an inductive coupler path between the coil 216 and a corresponding coil in the solenoid valve 130). Similarly, the coil 218 is adapted to activate or deactivate the solenoid valve 150 over signal line 174. Thus, depending on the direction of movement of the male coils 30 and 32 as determined from frequencies of received signals VRCVR, the microcontroller 210 selectively activates one of the coils 216 and 218 to open and close different ones of the solenoid valves 130 and 150.

In addition, the microcontroller 210 is coupled to receive signals from the pressure transducer 176. Based on which set of pressure pulse commands has been received at the pressure transducer 176, signals of different signatures are provided to the microcontroller 210. From the signals output by the pressure transducer 176, the microcontroller 210 activates and deactivates the coils 216 and 218 to open or close the valve 18A as indicated.

Figure 4:
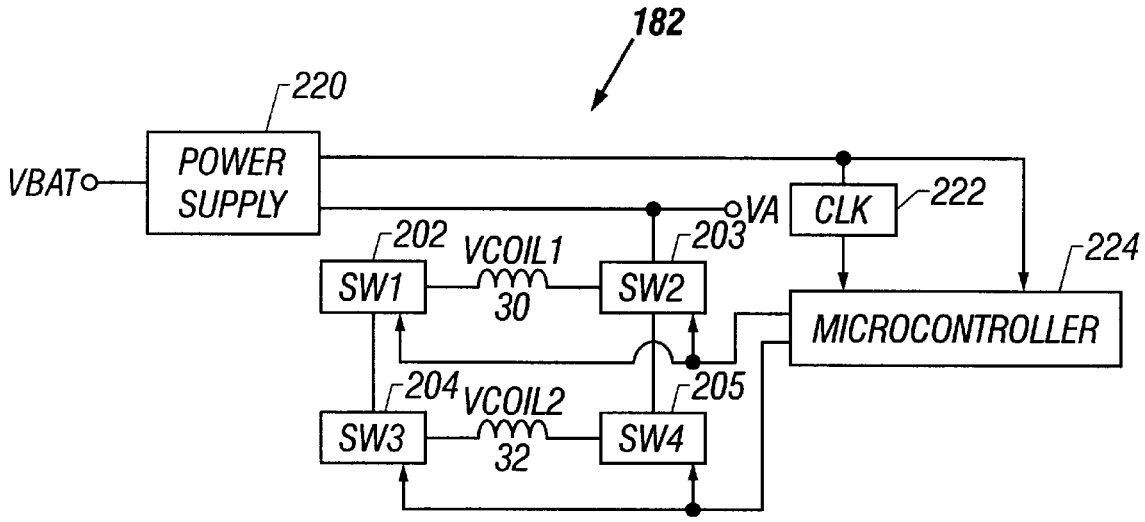

Referring to FIG. 4, a portion of the electronic circuitry 182 coupled to the male coils 30 and 32 is illustrated. Power supply voltages VA and VC are provided by a power supply 220 that receives the output of the battery 184 in the shifting tool 16. Again, the voltage VA may be about 24 V, for example, and the voltage VC may be about 5 V, for example.

Figure 6:
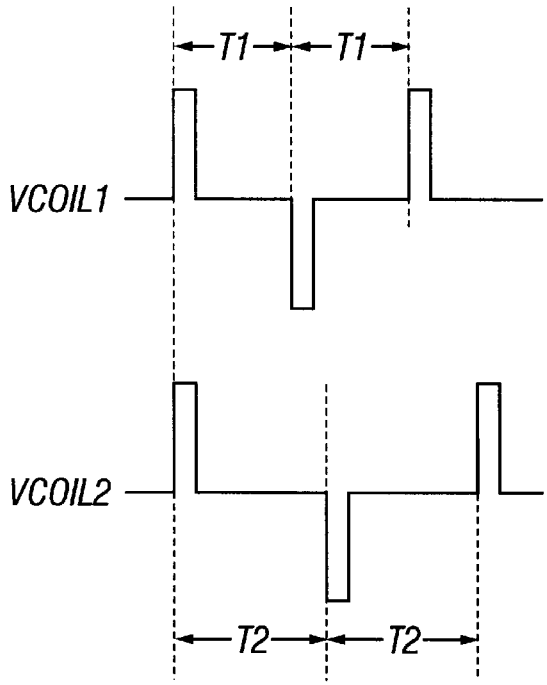

The power supply voltage VA is provided to switch circuits 202 and 203 that are coupled to the two ends of the male coil 30 and also provided to switch circuits 204 and 205 that are coupled to the two ends of the male coil 32. The switching circuits 202–205 are controlled by signals from a microcontroller 224. The microcontroller 224 receives the voltage VC and a clock from a clock generator 222. To generate a signal in the male coil 30, the switching circuits 202 and 203 are alternately activated and deactivated to produce a wave form VCOIL1 as illustrated in FIG. 6. The wave form VCOIL1 includes successive positive and negative polarity pulses. The switching circuits 202 and 203 control the polarity of the pulses generated in VCOIL1. The duration between pulses in VCOIL1 is a value T1.

To generate a signal in the male coil 32, the switching circuits 204 and 205 are alternately activated and deactivated to produce a wave form VCOIL2 as illustrated in FIG. 6. The wave form VCOIL2 also includes successive positive and negative polarity pulses having a duration T2 (different from T1) between successive pulses. The signals generated in the coils 30 and 32 are inductively coupled to the female coil 34 when the male coils are passed through the female coil.

Referring back to FIG. 5, the signal VFCOIL induced in the female coil has a duration T that is either T1 or T2 depending on which male coil is adjacent the female coil. Based on the duration T, the frequency of the square wave signal VRCVR produced by the receiver 206 may be one of two values. Depending on the detected frequency of the signal VCRVR, the microcontroller 210 can determine the direction of movement of the shifting tool 16.

Some embodiments of the invention may include one or more of the following advantages. Using a pressure pulse command to actuate the formation isolation valve according to an embodiment saves a trip into the wellbore for valve operation, which may save expensive oil rig time. Several well completion operations (e.g., automatic tubing filling, packer setting, and formation isolation) may be performed by the same tool string, which may result in significant rig time saving and lower costs. A shifting tool for the operation of the ball valve is reliable, as actuation of the formation isolation is less sensitive to gun debris, sand, and solid contamination downhole since the shifting tool does not have an engagement profile that can potentially get caught in the debris downhole. One or more standard valves may be kept on a shelf to reduce lead time, since the inner diameter of the valve does not have to be matched with the inner diameter of the shifting tool. This is so because no physical engagement is needed between the shifting tool according to some embodiments and the valve operator mechanism for valve operation. Use of the inductive coupler switch allows for a relatively large gap between the shifting tool and the inner walls defining the bore of the formation isolation system. Inadvertent operation due to pressure leaks is reduced so that the ball valve does not inadvertently open or close. For example, inadvertent opening of the ball valve when a fired perforating string is in the blowout preventer (BOP) may lead to an unsafe condition. The formation isolation system is versatile, as it may be used in both cemented liner and open hole completion applications. In addition, for operation of a ball valve as described, the valve operating mechanism described may be applied for operation of other types of valves, such as a sleeve valve.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A fluid control system actuatable by a tool, comprising:

a valve; and a valve operator coupled to operate the valve between an open and closed position, the valve operator adapted to be responsive to electrical signals generated by the tool such that a first combination of electrical signals is received when the tool is run in a first direction and a second combination of electrical signals is received when the tool is run in a second direction.

2. The system of claim 1, wherein the valve operator includes electronic circuitry adapted to actuate the valve open in response to the first combination and to actuate the valve closed in response to the second combination.

3. The system of claim 1, wherein the valve operator includes a portion of an inductive coupler switch.

4. The system of claim 3, wherein the inductive coupler switch portion includes a female coil and the tool includes a passive male element.

5. The system of claim 4, wherein the passive male element is formed of a magnetic material.

6. The system of claim 5, wherein the passive male element includes a ceramic magnetic material.

7. The system of claim 4, wherein the inductive coupler switch portion includes a second female coil.

8. A fluid control system actuatable by a tool, comprising:

a valve: and a valve operator coupled to operate the valve between an open and closed position, the valve operator adapted to be responsive to signals generated by the tool such that a first combination is received when the tool is run in a first direction and a second combination is received when the tool is run in a second, direction, wherein the inductive coupler switch portion includes a female coil and the tool includes a male coil.

9. The system of claim 8, wherein the tool further includes a second male coil.

10. The system of claim 9, wherein the female coil receives a first signal when the first male coil is next to the female coil and receives a second signal when the second male coil is next to the female coil.

11. The system of claim 8, wherein the inductive coupler switch portion includes a second female coil.

12. The system of claim 8, wherein the inductive coupler switch includes the male coil and the female coil.

13. A formation isolation valve comprising:

a valve; and a valve operator having a first mechanism responsive to a first type of command signal to actuate the valve and a second mechanism responsive to a second type of command signal to actuate the valve, wherein the first mechanism includes a pressure transducer.

14. The formation isolation valve of claim 13, wherein the first type of command signal includes a pressure pulse.

15. The formation isolation valve of claim 13, wherein the second mechanism includes a portion of an inductive coupler switch.

16. A system for use in a well comprising:

an activation tool; and a valve system actuatable by the activation tool, the valve system including a valve and a operator coupled to the valve, the operator including electronic circuitry adapted to detect direction of movement of the activation tool and to open or close the valve based on the detected direction of movement.

17. The system of claim 16, wherein the operator further includes a female coil.

18. The system of claim 17, wherein the activation tool includes a male coil.

19. The system of claim 18, wherein the activation tool includes another male coil.

20. The system of claim 19, wherein the electronic circuitry detects direction of movement of the activation tool based on which of the two male coils is first passed next to the female coil.

21. The system of claim 16, wherein the activation tool includes first and second inductive coupler portions and the operator includes a third inductive coupler portion adapted to be inductively coupled to the first and second inductive coupler portions.

22. The system of claim 21, wherein the first inductive coupler portion generates a first electrical signature and the second inductive coupler generates a second electrical signature.

23. The system of claim 16, wherein the activation tool includes a first inductive coupler portion and the operator includes second and third inductive coupler portions adapted to be inductively coupled to the first inductive coupler portion.

24. A method of operating a valve in a well, comprising:

passing an activation tool by a valve operator;

generating different electrical states in the valve operator by detecting direction of movement of the activation tool; and activating the valve based on the electrical state of the valve operator.

25. The method of claim 24, further comprising lowering the activation tool to open the valve.

26. The method of claim 24, further comprising raising the activation tool to close the valve.

27. The method of claim 24, further comprising transmitting a pressure pulse command down the well to actuate the valve operator.

28. A method of operating a valve in a well, comprising:

passing an activation tool by a valve operator;

generating different states in the valve operator depending on direction of movement of the activation tool: and activating the valve based on the state of the valve operator;

lowering the activation tool to open the valve;

raising the activation tool to close the valve; and maintaining the valve opened if the activation tool is raised within a predetermined amount of time after the activation tool has been lowered to open the valve.

29. The method of clam 27, wherein the well includes a tubing, the method comprising applying the pressure pulse command through the tubing.

30. The method of claim 27, comprising applying a low-level pressure pulse command down the well.

31. A valve operator comprising:

a mandrel moveable to operate a valve assembly;

a first chamber and a second chamber; and a first valve coupled to the first chamber actuatable to fill the first chamber with fluid or to remove fluid from the first chamber, pressure in the first chamber adapted to actuate the valve assembly to a first state ; and a second valve coupled to the second chamber actuatable to fill the second chamber with fluid or to remove fluid from the second chamber, pressure in the second chamber adapted to actuate the valve assembly to a second state.

32. The valve operator of claim 31, wherein each of the first and second valves includes a solenoid valve.

33. The valve operator of claim 32, further comprising electronic circuitry to control the first and second solenoid valves.

* * * * *